United States Patent [19]

Kötting

[11] Patent Number: 4,543,752

[45] Date of Patent: Oct. 1, 1985

[54] DEVICE FOR CENTERING SPECTACLE LENSES AND FOR FASTENING A HOLDING PART ON THE LENSES

[75] Inventor: Fritz Kötting, Dormagen, Fed. Rep. of Germany

[73] Assignee: Wernicke & Co. GmbH, Düsseldorf-Eller, Fed. Rep. of Germany

[21] Appl. No.: 448,520

[22] Filed: Dec. 10, 1982

[30] Foreign Application Priority Data

Dec. 23, 1981 [DE] Fed. Rep. of Germany ..... 3150967
May 14, 1982 [DE] Fed. Rep. of Germany ..... 3218241

[51] Int. Cl.[4] ..... B24B 41/06
[52] U.S. Cl. ..... 51/277; 51/217 L
[58] Field of Search ..... 51/277, 217 L, 216 LP

[56] References Cited

U.S. PATENT DOCUMENTS 2,293,291 8/1942 Gaspari .
3,737,238 6/1973 Reiner et al. .
3,738,065 6/1973 Tagnon ..... 51/217 L

FOREIGN PATENT DOCUMENTS 666179 2/1952 United Kingdom ..... 51/277

OTHER PUBLICATIONS

German Gebrauchsmuster 80 31 865.6, Published Mar. 1981.

*Primary Examiner*—Roscoe V. Parker
*Attorney, Agent, or Firm*—Becker & Becker, Inc.

[57] ABSTRACT

A device for centering spectacle lenses and for fastening a holding part on the lenses. The device includes a mounting base, a guide or column sleeve arranged vertically thereon, as well as a casing which is rotatable and displaceable in height, and to which a swivel arm which supports the holding part is connected. The object of the present invention is to make it possible, in a simple manner and without great structural expense and without taking a lot of time and effort, to be able to lower the holding part accurately vertically along a prescribed straight line onto the spectacle lens, so that the holding part maintains a desired precise position on the spectacle lens, and with the aid of which the lens can be inserted in an edge grinding machine. To realize this, the device is embodied such that a torque is exerted upon the casing during longitudinal movement relative to the column sleeve. As a result of this torque, a guide edge of the casing is held free of play in sliding engagement against a guide part or pin of the column sleeve.

11 Claims, 17 Drawing Figures

DEVICE FOR CENTERING SPECTACLE LENSES AND FOR FASTENING A HOLDING PART ON THE LENSES

BACKGROUND OF THE INVENTION

The present invention relates to a device for centering spectacle lenses and for fastening a holding part on the lenses; the device includes a mounting base, a guide or column sleeve arranged vertically thereon, as well as a height adjustable or displaceable and rotatable casing with which a swivel arm, which supports the holding part, is connected.

German Gebrauchsmuster No. 80 31 865.6, for example, discloses a device for centering spectacle lenses and for fastening a holding part on the lenses with a support which carries the lens, and a height adjustable and swingable supporting arm for the holding part, such as a block or suction apparatus which is to be mounted thereto. The supporting arm is subject to the force of a spring which presses or pulls the arm into its upper or lower end positions. A central guide or column sleeve is used around which the supporting arm is swivel mounted.

With the known devices, the swivel-mounted arm cannot be lowered exactly vertically onto the lens, since the swivel-mounted and height adjustable casing or bushing, which supports the arm, is guided on the column sleeve with play in the direction of rotation, i.e. in the circumferential direction of the casing. However, because of the transmission ratio of the distance between the holding part on the swivel arm and the column sleeve, each angular deflection of the arm allows errors to arise in the placement of the holding part on the lens, on the one hand regarding the distance or spacing of the guide part of the swivel arm, and on the other hand regarding the column sleeve.

It is therefore an object of the present invention to eliminate this disadvantage and, with simple means and without great structural expense and without taking a lot of time and effort, to be able to lower the holding part precisely vertically along a prescribed straight line onto the spectacle lens, so that the holding part maintains a desired precise position on the spectacle lens, and with the aid of which the lens can be inserted in an edge grinding machine, where the peripheral and bevel grinding is effected on the periphery of the lens.

It is a further object of the present invention to effect the play-free lowering of the casing, which is provided with the supporting arm, with a motor having an adjustable power.

BRIEF DESCRIPTION OF THE DRAWINGS

These and other objects and advantages of the present invention will appear more clearly from the following specification in connection with the accompanying drawings, in which.

SUMMARY OF THE INVENTION

Figure 1:
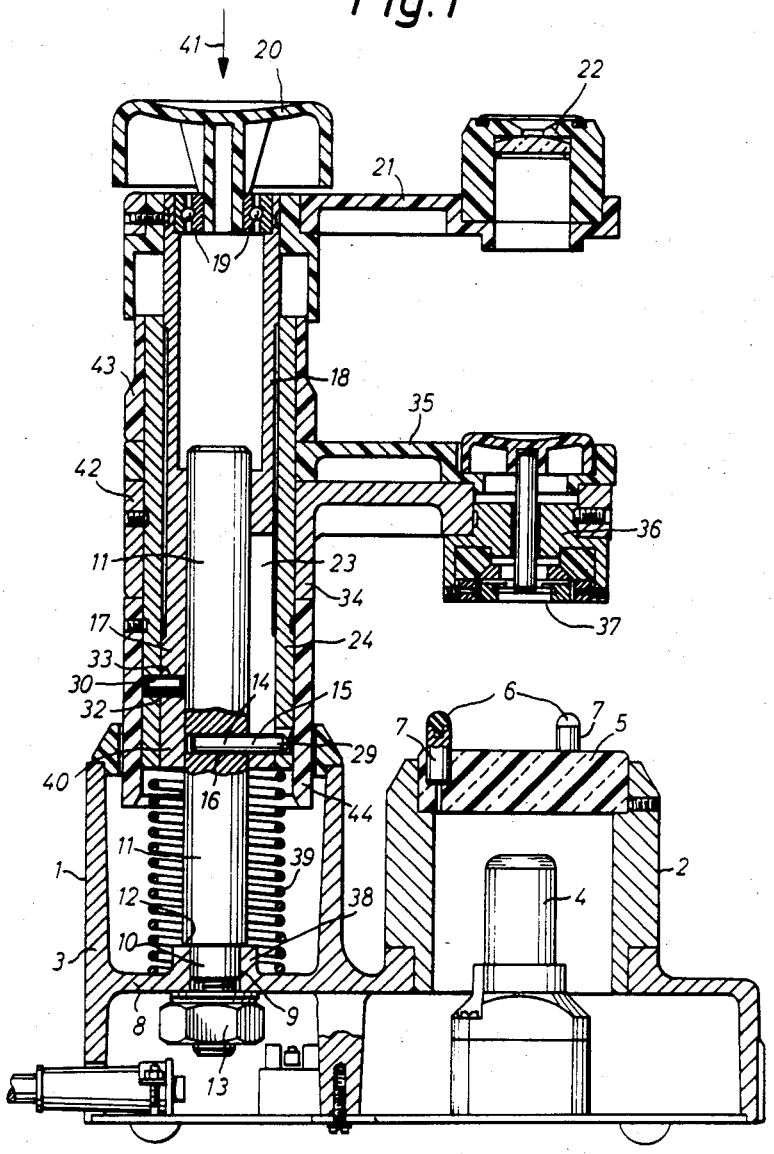
FIG. 1 is a vertical cross sectional view of one embodiment of the device according to the present invention, with manual lowering of the swivel arm.

The device of the present invention is characterized primarily in that a torque is exerted upon the casing during longitudinal travel motion or displacement adjustment relative to the column sleeve; as a result of the torque, a guide edge of the casing is held free of play in sliding engagement against a guide part or pin of the column sleeve.

Pursuant to specific embodiments of the present invention, the rotatable and height adjustable casing may be under the effect of a spring. A longitudinally slotted intermediate sleeve may be arranged between the guide or column sleeve and the casing, which may be provided with a right-angled guide slot; the column sleeve may be provided with a pin or the like which projects radially through the slots of the sleeve and the casing, and the casing may have an edge or curved part which extends at an angle to the longitudinal axis of the device, and against which a radial pin of the intermediate sleeve engages when the casing is pressed down against spring pressure.

The pin of the intermediate sleeve may engage in an inclined elongated hole of the casing. A compression spring may be arranged between the mounting base of the device and the casing, and the upper portion of the spring may surround the intermediate sleeve in the lowest position of the latter.

The projected length of the inclined elongated hole, as measured in the circumferential direction of the casing, may correspond at least approximately to the length of the circumferential segment of the right-angled guide slot of the casing.

The free end of the circumferential segment of the right-angled guide slot may be provided with a downwardly directed arresting recess.

The width of the elongated or longitudinal slot of the intermediate sleeve, and the width of the longitudinal segment of the right-angled guide slot of the casing may correspond to the thickness of the pin of the column sleeve guided in these slots, taking into consideration the play between the identified parts.

The inventive device may also include an outer sleeve which is adapted to be rotatably driven by a motor, and has a helical slot into which a radially outwardly directed pin of the casing engages. This pin may be located diametrically, or approximately diametrically, opposite to the vertical or longitudinal segment of the right-angled slot of the casing.

The helical slot of the outer sleeve may extend over 360°, or approximately 360°, of the periphery of this sleeve.

The present invention proceeds from the concept of imparting a torque during lowering of the holding part and the height adjustable and rotatable casing connected therewith, through which torque the casing, during its downward movement, continuously engages a pin arranged on the column sleeve. When the casing is pressed down counter to the spring pressure, the casing, with the aid of a pin and an inclined elongated hole, receives the noted rotary movement for cancelling of the play of the casing.

DESCRIPTION OF THE PREFERRED EMBODIMENTS

Referring now to the drawings in detail, the mounting base 1 of the device essentially comprises two parts, namely the housing part 2 which supports the spectacle lens, and the part 3 which supports the subsequently to be described column sleeve 11; the parts 2 and 3 are connected with each other. The housing part 2 of the mounting base 1 has a light source 4 in the interior thereof over which a transparent cover 5 is arranged through which the light of the light source 4 can radiate upwardly. Rod-shaped supports or pins 7 having rubber caps 6 are provided on the cover 5, preferably in a triangular arrangement, so that the inner side of the spectacle lens can be placed upon the caps 6 and can be shifted thereupon in all directions in order to attain the desired eccentricity or decentering. The lens can also be turned in order to bring an adjacent portion or the cylinder axis into the desired position.

The part 3 of the mounting base 1 has an intermediate bottom or partition 8 with a bore 9 through which the plug or pin-shaped end 10 of the vertical column sleeve 11 projects. The column sleeve 11 is held nonrotatably in position with the aid of the shoulder 12 and a nut 13. The end 14 of a guide pin 15 is inserted and held in a bore 16 located approximately halfway up the column sleeve 11. The upper portion of the column sleeve 11 is surrounded by an intermediate bushing or sleeve 17 which is only adjustable in height on the column sleeve 11. The upper cylindrical portion 18 of the intermediate sleeve 17 projects upwardly beyond the column sleeve 11, and has a shoulder bearing 19 at the upper end thereof, with the aid of which a knob 20 is rotatably connected with the intermediate sleeve 17 in such a way that the sleeve can be turned or rotated without the knob 20 also having to be turned.

An arm 21 is nonrotatably arranged at the upper end of the cylindrical portion 18 of the intermediate sleeve 17; the end of this arm 21 carries an optical system 22 which permits the spectacle lens on the rod-shaped pins or supports 7 to be observed from above.

Figure 8:
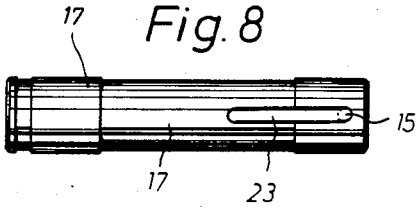
FIG. 8 is a side elevational view of the intermediate sleeve with the elongated slot.
Figure 9:
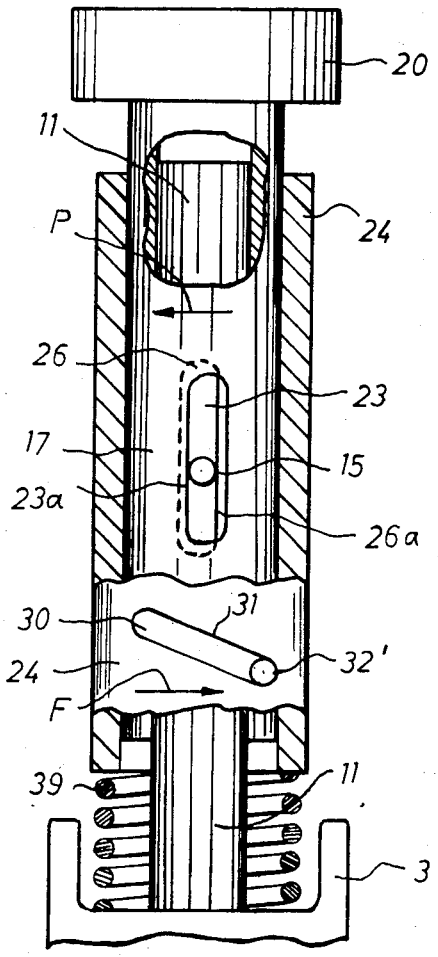
FIG. 9 is a schematic, partially sectioned and broken away elevational view to illustrate the operation of the parts of the device.
Figure 10:
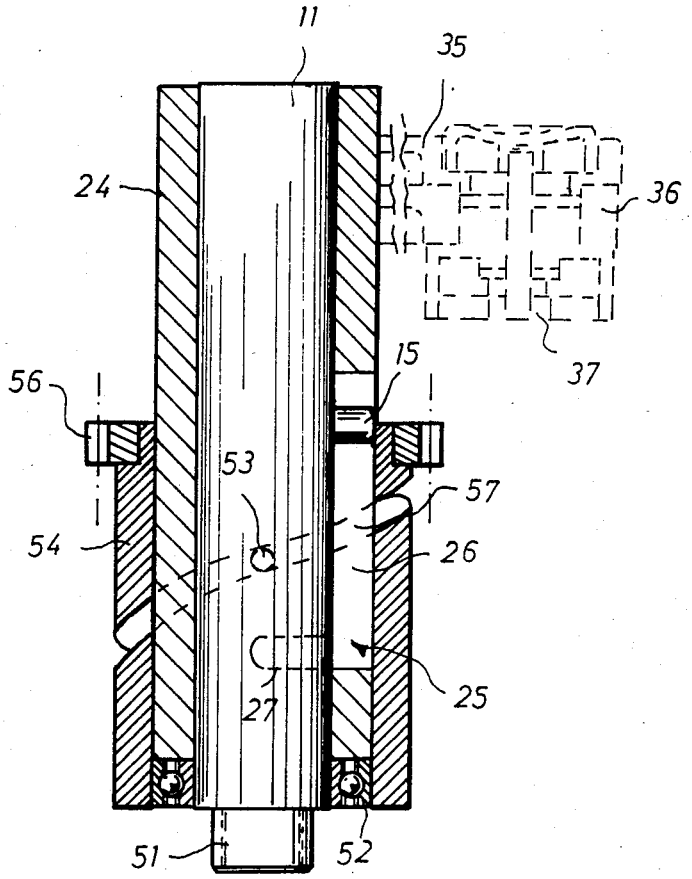
FIG. 10 shows a longitudinal cross sectional view of a further embodiment of the device according to the present invention, with motorized lowering of the swivel arm.
Figure 11:
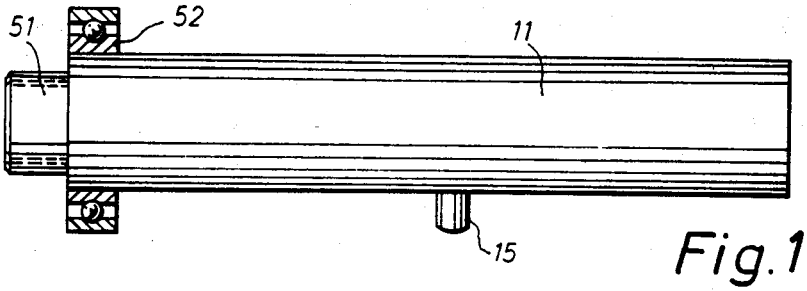
FIG. 11 shows a side elevational view of a column used in the embodiment of FIG. 10.
Figure 12:
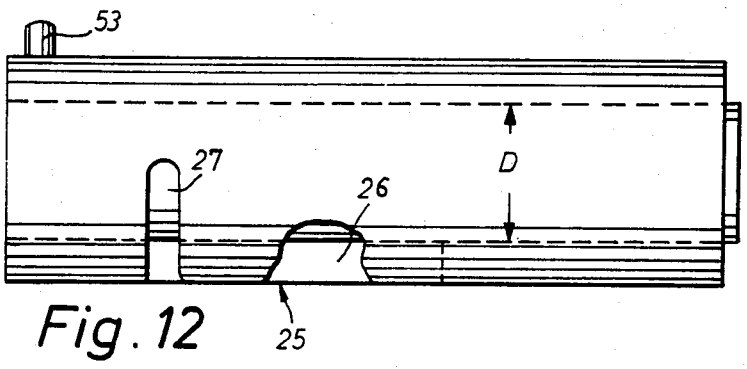
FIG. 12 is a partially broken-away view of a casing or sleeve for the embodiment of FIG. 10.
Figure 13:
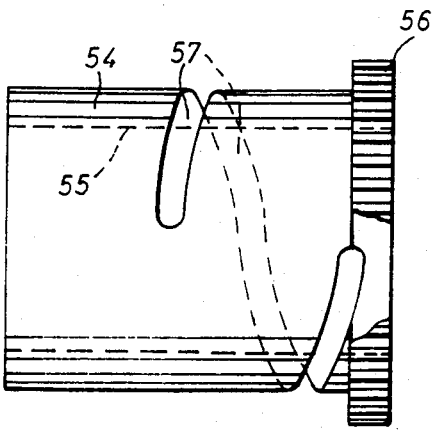
FIG. 13 is a side elevational view of an outer sleeve or bushing for the embodiment of FIG. 10.
Figure 14:
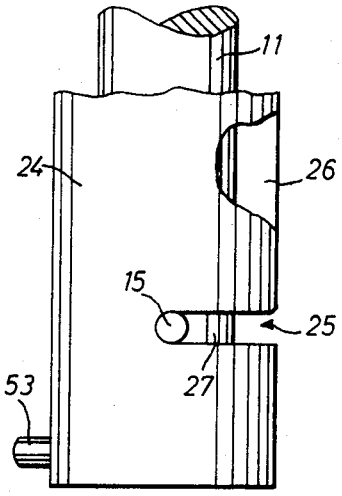
FIG. 14 is a fragmentary and partially broken-away elevational view of interfitting bushing and column of FIGS. 11 and 12.
Figure 15:
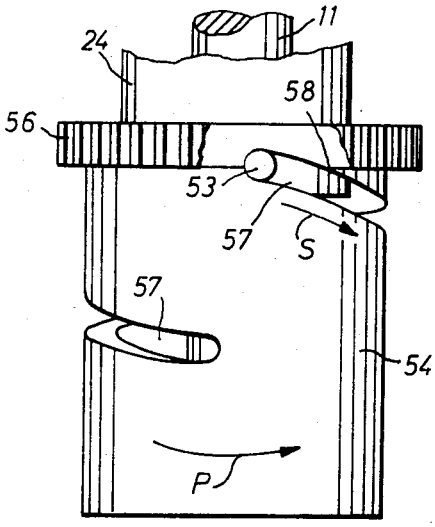
FIG. 15 is a fragmentary elevational view to show the interfitting relationship of the bushing and column of FIGS. 11 and 12 with respect to the outer casing of FIG. 13.
Figure 16:
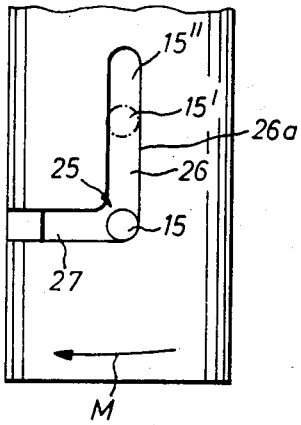
FIG. 16 is a fragmentary elevational view to illustrate alternate positioning of the bushing part of FIG. 14.

The intermediate sleeve 17 has an elongated or longitudinal slot 23 through which the guide pin 15 of the column sleeve 11 projects, so that the intermediate sleeve 17 is guided vertically on the column sleeve 11, but cannot turn. The elongated slot 23 extends over the lower portion of the intermediate sleeve 17, as shown in FIGS. 1,8 and 9.

Figure 4:
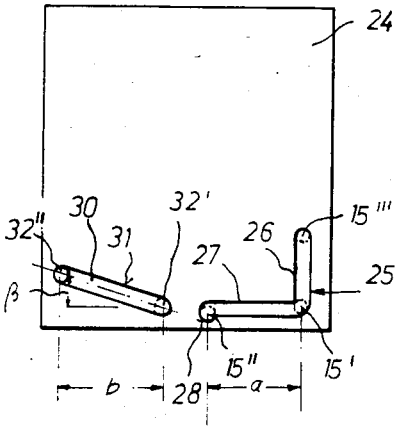
FIG. 4 illustrates the height adjustable and rotatable casing in an unrolled view showing features thereof.
Figure 5:
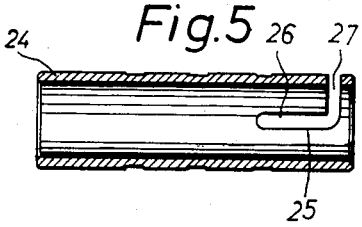
FIG. 5 is a longitudinal cross sectional view of the rotatable and height adjustable casing.
Figure 6:
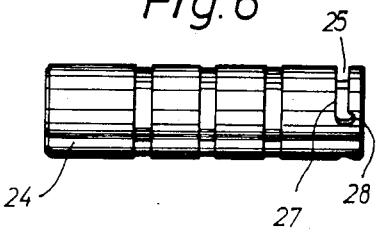
FIG. 6 is a side elevational view of the rotatable and height adjustable casing.
Figure 7:
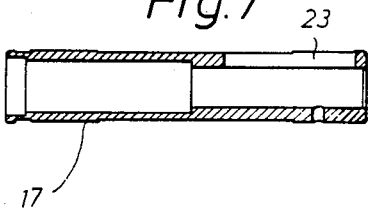
FIG. 7 is a longitudinally sectioned view of an intermediate sleeve or bushing having an elongated slot.

The intermediate sleeve 17 is surrounded by a casing 24 which is rotatable and longitudinally adjustable with respect to the sleeve 17. For this purpose, the lower portion of the casing 24, as recognizable in FIGS. 4, 5 and 6, is provided with a right-angled slot 25 having a vertical segment 26 which is disposed in the longitudinal direction of the casing 24, and, at right angles thereto, a horizontal segment 27 which is disposed in the circumferential direction of the casing 24. A downwardly directed recess 28 is located at the free end of the horizontal, circumferentially disposed slot segment 27. The outer end 29 of the guide pin 15 of the column sleeve projects into the right-angled slot 25 in such a way that the pin 15 passes through the elongated slot 23 of the intermediate sleeve 17 and projects into the right-angled slot 25 of the casing 24.

A slotted or elongated hole 30 starts in the vicinity of the free end of the horizontal, circumferentially disposed segment 27 of the slot 25; the elongated hole 30 has an inclination $\beta$ (FIG. 4) relative to the horizontal cross sectional plane of the casing 24, and forms an upper guide edge 31 for a pin 32, the inner end of which is held in a bore 33 of the intermediate sleeve 17.

A cylindrical outer part 34 is non-rotatably and fixedly connected with the casing 24; a swivel arm 35 is fastened to the outer part 34. The head part 36 of this swivel arm 35 can, at 37, receive the holding part which is to be pressed onto the top or upper side of the spectacle lens which rests on the pins or supports 7.

A compression spring 39 is arranged between the casing 24 and an extension 38 of the intermediate bottom or partition 8 of the part 3 of the base 1. This spring 39 endeavors to press the casing 24 upwardly. The upper segment of the spring 39 surrounds the lower region 40 of the intermediate sleeve 17 when the sleeve 17 occupies its downwardly extended position relative to the casing 24, whereby the pin 32 occupies the position 32' (FIG. 4) in the inclined elongated hole or slot 30, and the guide pin 15 occupies the position 15'.

The length "a" of the segment 27 of the right-angled slot 25, measured in an arc or circular measure, corresponds to the projected arc length "b" of the inclined slot 30 and determines the magnitude of the swivel movement of the arm 35 over the angle $\alpha$ (FIG. 2) relative to the stationary arm 21 which is provided with the optical system 22.

Figure 2:
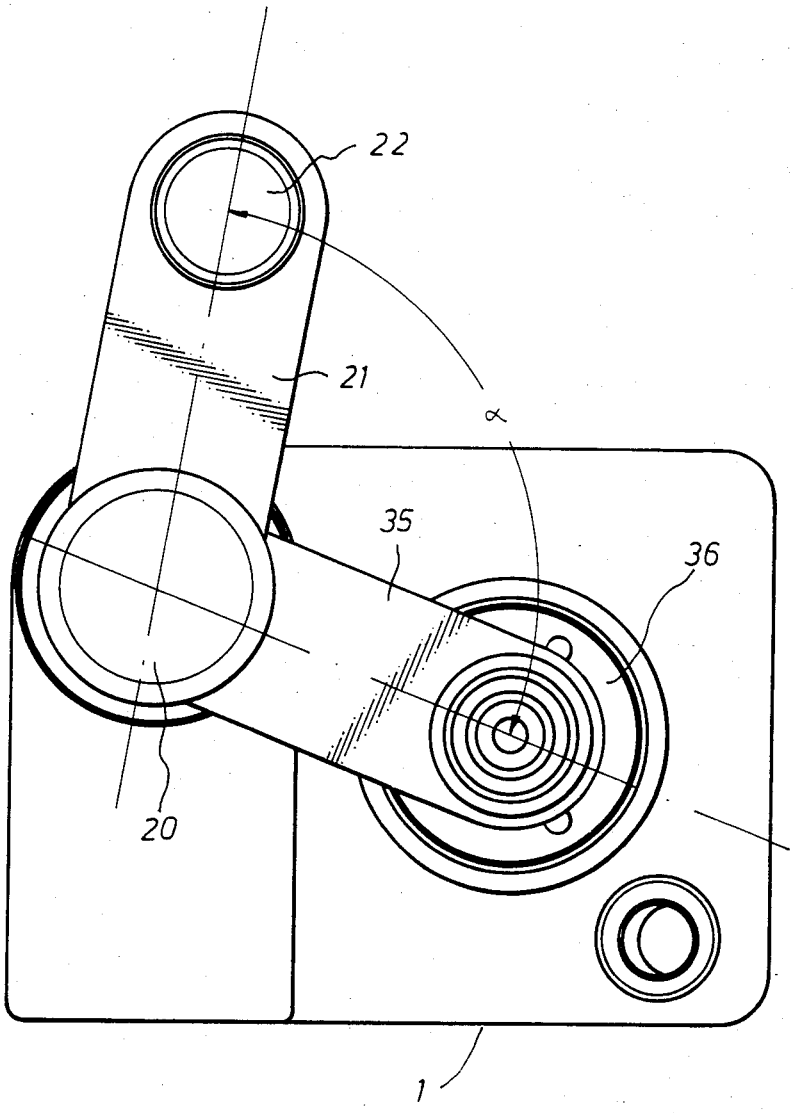
FIG. 2 is a plan view of the device according to FIG. 1.
Figure 3:
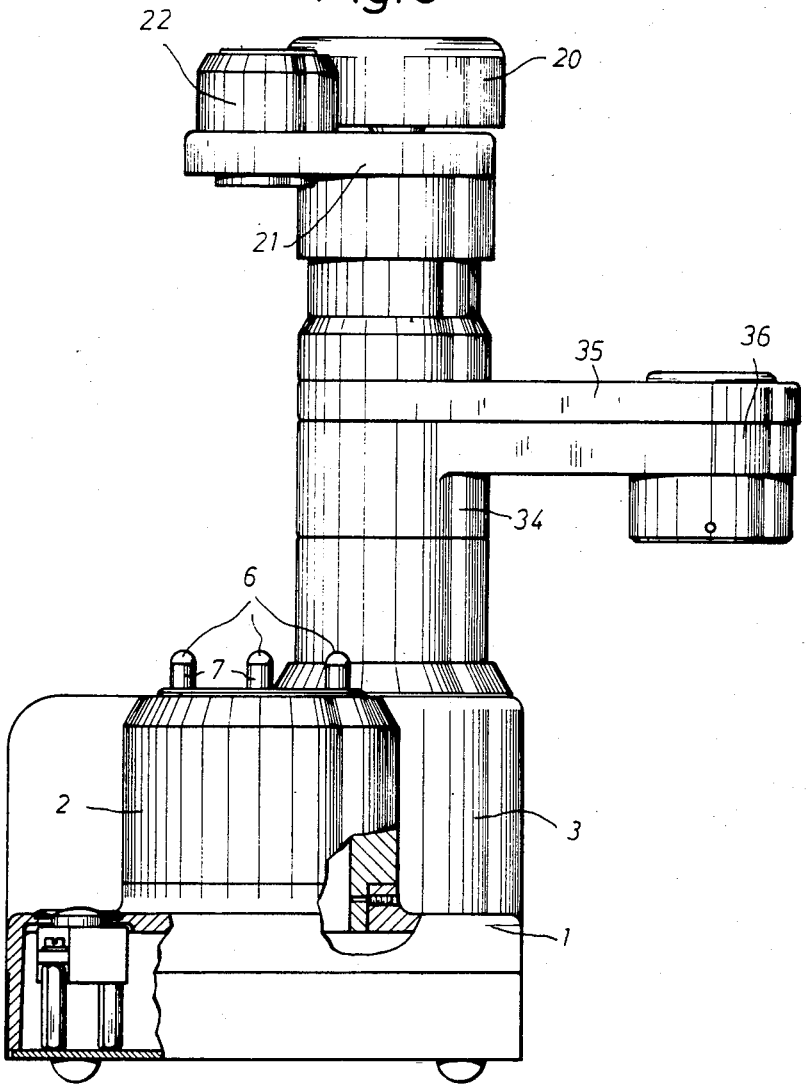
FIG. 3 is a partially broken away side elevational view of the device of FIG. 1.

The mode of operation of the device is illustrated hereinafter with the aid of FIGS. 1, 4 and 9. In the starting position of the parts of the device, the spring 39 presses the casing 24, with the swivel arm 35 fastened thereon into the upper starting position. The intermediate sleeve 17 is hereby turned or rotated relative to the column sleeve 11 in its uppermost position and relative to the casing 24 in such a way that the pin 32 occupies the position 32'' in the elongated hole or slot 30, whereby the pin 15 occupies the position 15'' in the recess 28 (FIG. 4). The swivel arm 35 is in its extended and elevated position, relative to the arm 21, as represented in FIGS. 2 and 3. If a pressure is now exerted upon the knob 20 in the direction of the arrow 41 (FIG. 1), the intermediate sleeve 17 is moved or shifted downwardly in the casing 24, and in so doing the casing 24 is turned or rotated, since the pin 32 slides in the elongated hole 30 until it reaches the position 32′ and the pin 15 reaches the position 15′. The arm 35 is then located over the part 2. If further pressure is exerted upon the knob 20, the pin 15 slides in the slot 23 of the intermediate sleeve 17, and in the segment 26 of the right-angled slot 25, into the position 15‴. In so doing, the head part 36 of the swivel arm 35 is pressed onto the spectacle lens.

Essential for precise placement of the holding part on the spectacle lens is that the holding part on the head part 36 be lowered free of play and exactly vertically from its elevated position onto the lens. As carried out, the pin 32 is located in the position 32′ at the beginning of the lowering of the casing 24 and of the head part 36, and the pin 15 is located in the position 15′. When the knob 20 is pressed down against the pressure of the spring 39 upon the casing 24, the pin 32 is pressed against the upper guide edge 31 with the result that the casing 24 receives a tendency or moment toward relative rotation with respect to the intermediate sleeve 17 (FIG. 9, arrows P and F). As a consequence, the edge 23*a* of the slot 23 is pressed against the pin 15 from one side and, a fact which is decisive for the guidance of the swivel arm 35, the edge 26*a* of the segment 26 of the right-angled slot 25 is pressed against the pin 15 from the other side. In so doing, however, the casing 24 receives a precise vertical guidance, even during up and down movement of the swivel arm 35. The swivel arm 35 is rigidly connected with the casing 24 via a support ring 42; the casing 24 is surrounded by parts 43, 44 above and below the ring 42, as shown in FIG. 1 of the drawings.

As apparent from the foregoing, the intermediate sleeve 17 can only be shifted or adjusted longitudinally relative to the column sleeve 11 because of the pin 15; the casing 24 on the other hand can be rotated and longitudinally adjusted relative to the column sleeve 11 with the pin 15 in the segments 26 and 27 of the slot 25, and the intermediate sleeve 17 can be rotated and longitudinally adjusted relative to the casing 24 because of the elongated hole 30 and the pin 32.

The device according to FIGS. 10–17 inclusive has a column sleeve 11 just like the embodiment according to FIGS. 1 through 9; the lower threaded end 51 of the column sleeve 11 is again held nonrotatable in the mounting base 1. The radial guide pin 15 projects outwardly approximately halfway up the cylindrical column sleeve 11; the guide pin 15 engages in the casing 24, which has a diameter D. The lower end of the column sleeve 11 has a radial bearing 52. The construction of the parts 24 through 27 and 35 through 37 corresponds to those illustrated in FIGS. 1 through 9.

The lower end of the column sleeve 11 is provided with a radially outwardly directed pin 53 on that side located opposite to the vertical segment 26 of the right-angled slot 25.

The casing 24 is rotatable in an outer sleeve or bushing 54, and is guided in longitudinal direction along the inner wall 55 thereof. A gear ring 56 is arranged at the upper edge of this outer sleeve 54; a driving member of a drive unit of a coupling or of a motor engages the gear ring 56 in such a way that the outer sleeve 54 can be rotated or turned as adjusted according to speed and power. A helical slot 57, which extends around approximately 360° in the sleeve 54, starts in the vicinity of the gear ring 56; the pin 53 of the casing 24 engages in this slot 57.

The mode of operation of the device of the embodiment according to FIGS. 10 through 17 is as follows. In the starting position of the parts according to FIGS. 14 and 15, the casing 24 is located relative to the column sleeve 11 in a position in which the pin 15 is located at the closed end of the horizontal segment 27 of the right-angled slot 25. In this position, the pin 53 rests against the upper closed end of the helical slot 57. The casing 24 is completely extended, and the lower end 58 of the casing 24 is located for example in the upper region of the helical guide slot 57. This position of the parts is attained by turning the outer sleeve 54 in the direction of the arrow P until the two pins 15 and 53 have reached the described positions. When the pins are in these positions, the swivel arm 35 with the head part 36 occupies its highest position and is located in the swung-out position, i.e., in an angular position of 90° laterally adjacent to the spectacle lens supporting-part.

Figure 17:
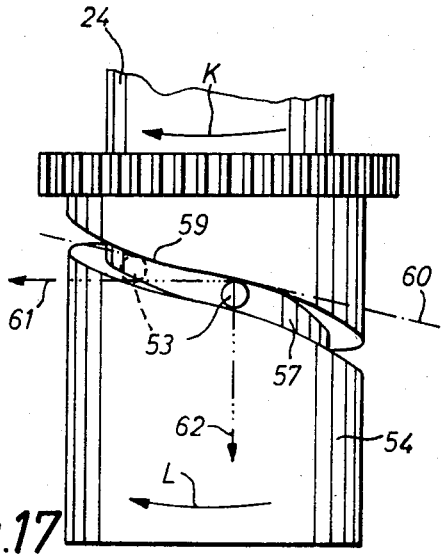
FIG. 17 is a fragmentary elevational side view that illustrates alternate positioning of the bushing with the outer casing.

In order to now first attain a retraction or swinging-in of the swivel arm 35 and of the holding or head part 36 to the level of the spectacle lens, the outer sleeve 54 is turned with the aid of the gear ring 56 counter to the direction of arrow P in the opposite direction represented by the direction of arrow L in FIG. 17. The pin 53 hereby initially remains in its position at the upper end of the slot 57. The pin 15, on the other hand, slides along the horizontal segment 27 of the right-angled slot 25 into the position represented by a solid line in FIG. 16 at the transition of the segment 27 of the right-angled slot 25 into the vertical segment 26 thereof. The swivel movement of the casing 24 is terminated after the pin 15 encounters the wall 26*a* of the vertical segment 26 of the right-angled slot 25; this means that the swivel arm 35 with the holding or head part 36 has reached the level of the spectacle lens. A downward movement of the swivel arm 35 with the head part 36 first begins hereafter, and is brought about in that on the one hand the pin 53 of the casing 24 travels in the helical guide slot 57 in the direction of arrow S (FIG. 15), and on the other hand at the same time, however, the pin 15 passes the positions 15′ and reaches one of the end positions 15″, in which the holding or head part 36 rests upon the spectacle lens. To accomplish this, either the motor or a suitably preceding coupling can be varied in speed and placement force in conformity with the type and thickness of the spectacle lens.

In order to assure a lowering of the swivel arm 35, and of the holding part arranged on the head part 36, in a manner free of play, the pin 15, as with the embodiment according to FIGS. 1 through 9, slides along the edge or wall 26*a* of the vertical segment 26 of the right-angled slot 25; this means that a torque is exerted upon the guide or casing 24 in a manner which assures a continuous engagement of the edge 26*a* against the stationary pin 15 of the column sleeve 11. This occurs because during turning or rotation of the outer sleeve 54 in the direction of the arrow L in FIG. 17, the pin 53 of the casing 24 is guided along the upper edge 59 of the slot 57. A horizontal component 61 and a vertical component 62 result as resultants due to the inclined or sloping position of the tangent 60 at the point of contact. The horizontal component 61 attempts to take along the casing 24 in the same direction (see arrow K in FIG. 17) and accordingly to impart a turning or rotary movement to the casing 24 in the direction of the arrow M in FIG. 16. However, in so doing, the edge or wall *26a* is brought into continuous engagement against the stationary pin 15, thus assuring the lowering of the casing 24 free of play even with motorized operation and adjustable speed and force of placement of the holding or head part 36.

The embodiment according to FIGS. 10 through 17 takes into consideration that the spectacle lens blanks for concave lenses have a thick edge and a thin central region, while plus-correction lenses conversely have a thicker central region and a thin edge portion. The thicker the corrective lens is, the more significant the differences between the central region of the spectacle lens blank and the edge portion thereof become. The lowering of the holding part onto the lens with a speed and operating force which are independent of the subjective strength of the operator, and dependent upon the type and thickness of the spectacle lens, is therefore of great importance. The device according to FIGS. 10 through 17 offers not only a motorized lowering of the holding or head part 36 of the swivel arm 35, but rather also offers the possibility of being able to adjust the motorized movement according to force and speed in such a way that the motorized movement corresponds to the foregoing requirements.

The present invention is, of course, in no way restricted to the specific disclosure of the specification and drawings, but also encompasses any modifications within the scope of the appended claims.

What I claim is:

1. A device for centering a spectacle lens positioned precisely for placement thereof via a holding part on said lens, said device comprising:

a mounting base;

a column sleeve arranged vertically on said mounting base and provided with a guide means;

a rotatable casing disposed around said column sleeve and provided with a guide edge; means for height adjustment of said casing relative to said column sleeve, means with which a torque is exerted upon said casing during longitudinal movement thereof relative to said column sleeve, means for holding said guide edge of said casing in sliding engagement and free of play against said guide means of said column sleeve as a result of said torque; and a swivel arm, which is connected with said casing and supports said holding part.

2. A device according to claim 1, which includes a spring associated with said column sleeve, said casing being under the effect of said spring.

3. A device according to claim 2, in which said casing is provided with a right-angled slot which includes a circumferentially directed segment and a longitudinally directed segment, with said guide edge of said casing being formed by said longitudinally directed segment; which includes an intermediate sleeve which is provided with a longitudinal slot and is disposed between said column sleeve and said casing; in which said guide means of said column sleeve is a pin-like member which projects through said longitudinal slot of said intermediate sleeve and through said right-angled slot of said casing; in which said casing is provided with a further edge which is inclined relative to the longitudinal axis of said column sleeve; and in which said intermediate sleeve includes a radial pin which engages said further edge of said casing when the latter is pressed down against the pressure of said spring.

4. A device according to claim 3, in which said casing includes an inclined elongated hole which forms said further edge of said casing, said radial pin of said intermediate sleeve engaging in said elongated hole.

5. A device according to claim 4, in which said spring is a compression spring which is disposed between said mounting base and said casing, with the upper portion of said spring surrounding said intermediate sleeve in the lowest position of the latter.

6. A device according to claim 4, in which the projected length of said inclined elongated hole, as measured in the circumferential direction of said casing, corresponds at least approximately to the length of said circumferential segment of said right-angled slot.

7. A device according to claim 4, in which the free end of said circumferential segment of said right-angled slot is provided with a downwardly directed arresting recess.

8. A device according to claim 4, in which the width of said longitudinal slot of said intermediate sleeve, and the width of said longitudinal segment of said right-angled slot of said casing, correspond to the thickness of said pin-like member of said column sleeve guided in these slots, allowing for the play between said parts.

9. A device according to claim 1, in which said casing includes a radially outwardly directed pin; and which includes an outer sleeve which is disposed about said casing and is adapted to be rotatably driven by a motor, said outer sleeve being provided with a helical slot into which said pin of said casing engages.

10. A device according to claim 9, in which said casing is provided with a right-angled slot which includes a circumferentially directed segment and a longitudinally directed segment, with said guide edge of said casing being formed by said longitudinally directed segment; and in which said radially outwardly directed pin of said casing is located at least approximately opposite to said vertical, i.e. longitudinally directed, segment of said right-angled slot.

11. A device according to claim 10, in which said helical slot of said outer sleeve extends over at least approximately 360° of the periphery of said outer sleeve.

* * * * *